US008065830B2

(12) United States Patent
Twardy

(10) Patent No.: US 8,065,830 B2
(45) Date of Patent: Nov. 29, 2011

(54) MULTIPLE MAGAZINE LOADER

(76) Inventor: Chris Twardy, Lake Villa, IL (US)

( * ) Notice: Subject to any disclaimer, the term of this patent is extended or adjusted under 35 U.S.C. 154(b) by 0 days.

(21) Appl. No.: 12/154,488

(22) Filed: May 23, 2008

(65) Prior Publication Data

US 2009/0288326 A1 Nov. 26, 2009

(51) Int. Cl.
*F41A 9/83* (2006.01)

(52) U.S. Cl. ..... 42/87; 42/108

(58) Field of Classification Search ..... 42/87, 50, 42/106, 108; D22/108
See application file for complete search history.

(56) References Cited

U.S. PATENT DOCUMENTS 1,786,537 A * 12/1930 Holek ..... 86/47
4,827,651 A * 5/1989 Conkey ..... 42/87
4,993,180 A * 2/1991 Upchurch ..... 42/87
5,309,662 A * 5/1994 Goodwin et al. ..... 42/105
D348,503 S * 7/1994 Claveau ..... D22/108
5,417,003 A * 5/1995 Claveau ..... 42/90
6,219,953 B1 * 4/2001 Bentley ..... 42/90
6,286,243 B1 * 9/2001 Hinton ..... 42/87
D477,047 S * 7/2003 Springer ..... D22/108
6,810,616 B2 * 11/2004 Tal et al. ..... 42/87
6,817,134 B2 * 11/2004 Newman ..... 42/87
D540,631 S * 4/2007 Bryant ..... D8/14
7,257,919 B1 * 8/2007 Farley ..... 42/87
D566,804 S * 4/2008 Hahin ..... D22/108
7,487,613 B2 * 2/2009 Taylor ..... 42/87
2004/0020096 A1 * 2/2004 Tal et al. ..... 42/87
2004/0159035 A1 * 8/2004 Newman ..... 42/87
2004/0159036 A1 * 8/2004 Newman ..... 42/87
2006/0162224 A1 * 7/2006 Connal ..... 42/108
2007/0017140 A1 * 1/2007 Pikielny ..... 42/87
2008/0244952 A1 * 10/2008 Taylor ..... 42/87

OTHER PUBLICATIONS

Universal Mag Tool instruction manual—front and back copied onto two pages.

* cited by examiner

*Primary Examiner* — Benjamin P Lee
(74) *Attorney, Agent, or Firm* — The Eclipse Group LLP

(57) ABSTRACT

A firearm magazine loading and unloading tool that may be formed in a one-piece unit that is hand-held, ambidextrous, generally rectangular in shape and able to fit inside one or more magazines.

15 Claims, 7 Drawing Sheets

MULTIPLE MAGAZINE LOADER

FIELD OF THE INVENTION

This magazine loader relates to firearms and their magazines sometimes referred to as clips; and more specifically, to a device for assisting in loading bullets in to and unloading bullets out of a magazine used by a firearm.

DISCUSSION OF THE RELATED ART

As magazine-fed firearms are commonly used for self defense, hunting, target shooting, and other legal purposes, in addition to being used by the police and military forces, it is desirable in all of these instances to have firearm magazines (sometimes referred to as clips) which are filled to their normal, standard capacity. Firearm magazines, as they are loaded with rounds, become increasingly more difficult to load. This is typically due to the spring's asserting pressure on the rounds already within the firearm magazine. The upward force or pressure increases with each successive round loaded in the firearm magazine.

The insertion of rounds into the firearm magazine is usually done with the thumb and fore fingers of the hand, which themselves become fatigued (or even injured by edges of the magazine opening) as additional force is required with each successive round attempted at loading within the same firearm magazine; and further likely with loading of multiple magazines. Firearm magazines may contain from 6 to 40 rounds of ammunition, and depending on the thumb, finger, or hand strength of the user, or time available, a user may not be able to load the firearm magazine to its normal, full capacity, thereby reducing the full utility or firepower benefit of the weapon. Similarly, the unloading of partial or fully loaded magazines by using only fingers is equally difficult and may result in fatigue and injury, especially when unloading multiple firearm magazines.

Previous known approaches to assist in firearm magazine loading and unloading incorporate rings worn on the thumb, sleeves or boxes which fit or attach over the top opening and outside dimensions of firearm magazines, and/or have brackets or moving levers or arms, or spring activated cams, or some combination of parts thereof. The use of brackets and sleeves that attach to over the firearm magazine typically result in a device that is only usable on one type of magazine. As the number of parts forming a device are increased in number, the potential for any one part failing, wearing out or breaking increases and results in the device being useless in a life or death situation.

What is needed is an approach to loading and unloading firearm magazines that is reliable and protects the fingers and hands from fatigue and injury.

SUMMARY

A firearm magazine loading and unloading device that is hand-held with the core of the device typically being a single piece. The device is able to fit into a multitude of different types of firearm magazines that hold different caliber rounds. It is ambidextrous, usable by either hand, where the user may or may not have a full set of functioning fingers, a minimum of only one or two functioning fingers is all that is typically needed to grasp and use the device.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

The foregoing description of an implementation has been presented for purposes of illustration and description. It is not exhaustive and does not limit the claimed inventions to the precise form disclosed. Modifications and variations are possible in light of the above description or may be acquired from practicing the invention. Note also that the implementation may vary between systems. The claims and their equivalents define the scope of the invention.

DETAILED DESCRIPTION

Figure 1:
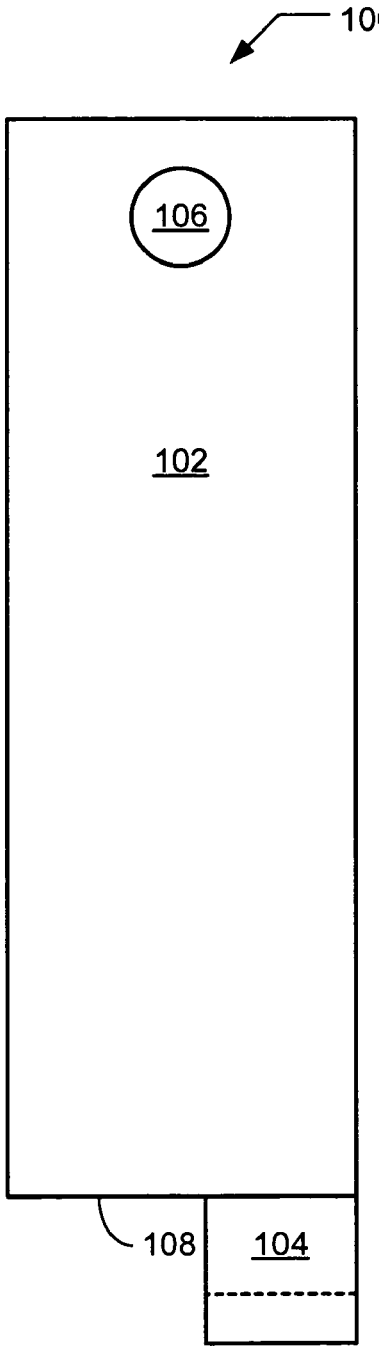
FIG. 1 is a diagram of a top view of an example implementation of the magazine loader lying flat on its side.

An approach for a firearm magazine loading and unloading tool that may be formed in as a one-piece unit that is hand-held is described. It may be used to quickly load or unload different sized (i.e. different firearm/caliber-specific) and different capacity firearm magazines while reducing fatigue and injuries of a user's thumbs, fingers and hands. In FIG. 1, a diagram 100 of a top view of an example implementation of the magazine loader 102 lying on its side is shown. The magazine loader 102 may be ambidextrous and generally rectangular and solid in shape. The magazine loader 102 in the present implementation may have a maximum outside dimensions approaching 4.75 inches in length, by 1.25 inches in width, by ⅜ (0.375) inches thick. The magazine loader 102 has an upper rectangular area with an extension 104 that extends below the upper rectangular area.

The top of the upper rectangular area of the magazine loader 102 may be a flat running plane, extending the entire width of the tool and cut 90 degrees to the two flat parallel front and back end planes of the rectangular area. The top itself may provide a shelf for the user's grasping hand thumb to optionally press or ride upon when using the tool as a loader. Slightly below the Top and centered a hole 106 may be bored transversely thru the side of the magazine loader 102, for the convenience of hanging the loader on a hook or nail-type protrusion, or for the acceptance of a length of tied lanyard, cord, or rope, or for the attachment of a carabineer or other type quick connect-disconnect ring fasteners to better facilitate carriage of the magazine loader 102 or to be better able to retrieve the magazine loader 102 when stowed inside pockets, bags, cases, containers, or pouches.

The bottom of the rectangle area may also be a flat running plane, in parallel with the top plane and also cut 90 degrees to the two parallel front and back end planes, however, 0.5 inch long up from the bottom, it comprises a rectangular cut-out across its width, leaving a stop ledge plane 108 and the protruding rectangular extension 104. The extension may be referred to as an Action Post and may have dimensions of nearly 0.312" inches wide×0.5 inches" long at the front end plane. This extension 104 and its nearby adjoining connection point on the upper portion of the magazine loader 102 may be slightly reduced in thickness in order to fit freely between the feed lips of magazines.

Figure 2:
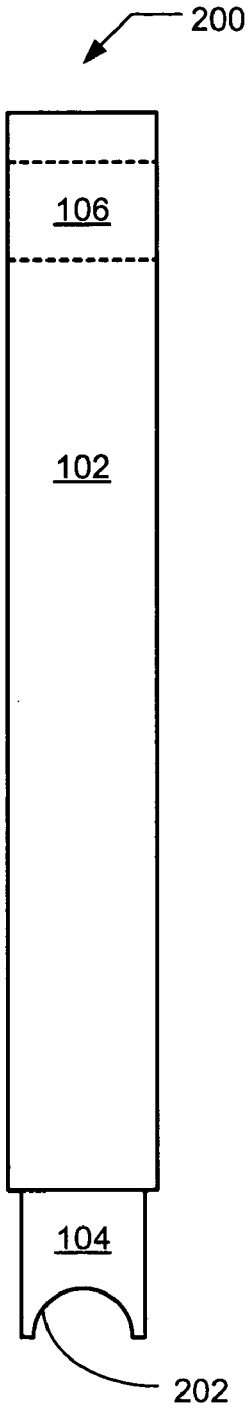
FIG. 2 is a diagram of a left end view of the magazine loader of FIG. 1.

Turning to FIG. 2, a diagram 200 of a left end view of the magazine loader 102 of FIG. 1 is shown. The end of the extension 104 may have an inwardly curved surface 202 for its entire width. The inwardly curved surface 202 may be used to mate with the outwardly curved surface of firearm ammunition cartridges or rounds when inserting rounds into a magazine or clip. The outside dimension of the extension 104 in the left end view is seen to be less than the outside dimension of the upper rectangular area.

Figure 3:
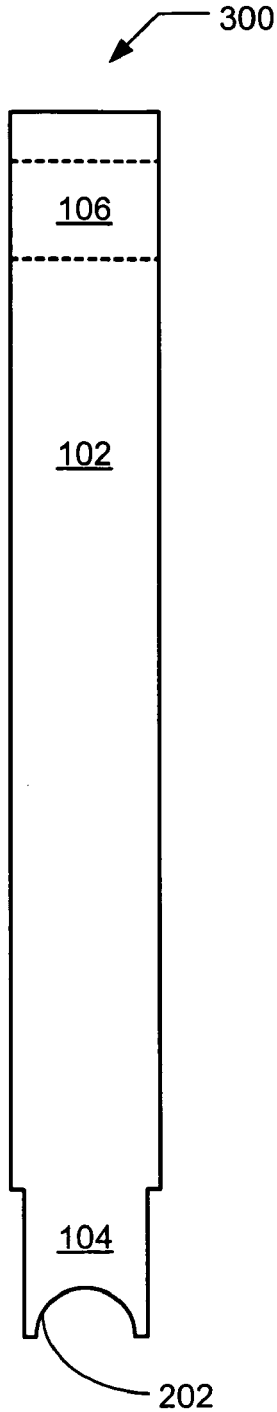
FIG. 3 is a diagram of a right end view of the magazine loader of FIG. 1.

In FIG. 3 a diagram 300 of a right end view of the magazine loader 102 of FIG. 1 is shown. As in FIG. 2, the outside dimension of the extension 104 in the right end view of FIG. 3 is seen to be less than the outside dimension of the upper portion of the magazine loader 102. The right end of the extension 104 may be flush with the right end of the upper portion of the magazine loader 102. In other implementations, the magazine loader may be formed in two or more portions that are secured together with glue, welds, or mechanical fasteners.

The magazine loader 102 may be positioned in a fist-like grasp of either hand with the top oriented toward the opening created by the index finger; the front leading edge of the front end plane, of the extension 104 at the bottom of the magazine loader 104, is oriented outwardly at a position furthest away from the wrist, and protrudes from the opening created by the pinky or outermost finger.

Figure 4:
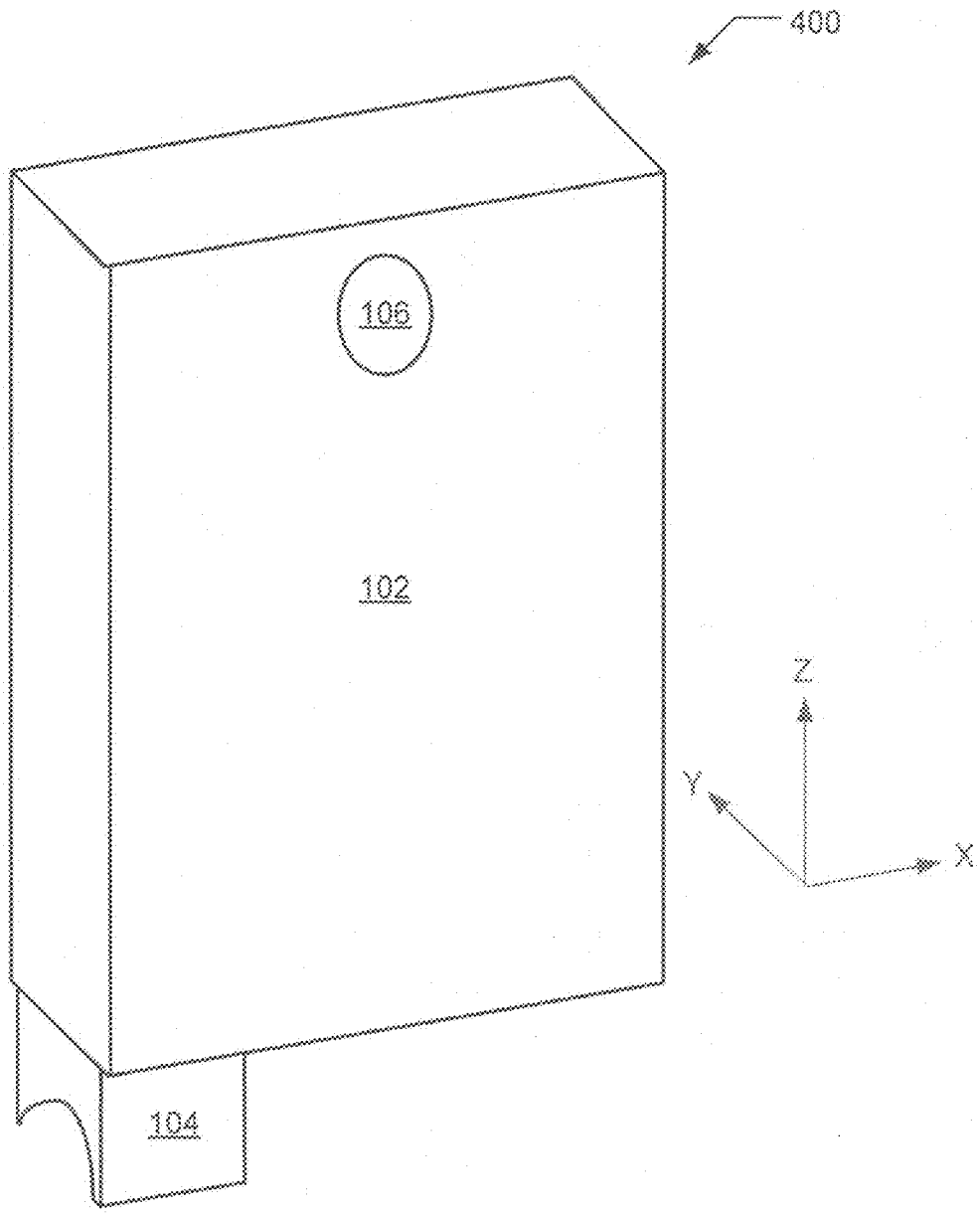
FIG. 4 is a diagram of a three-dimensional view of the magazine loader of FIG. 1.

Turning to FIG. 4, a diagram 400 of a three-dimensional view of the magazine loader 102 of FIG. 1 is shown. The magazine loader 102 has an extension 104 that protrudes from the bottom plane of the magazine loader 102. In other implementations, the extension 104 may be on any of the magazine loader 102 edges. In yet other implementations, two or more of the edges may have one or more extensions preferably perpendicular to the plane of the edge. The extension 104 may be formed or machined to have an inward curved surface 202 adapted to engage the cartridge.

Figure 5:
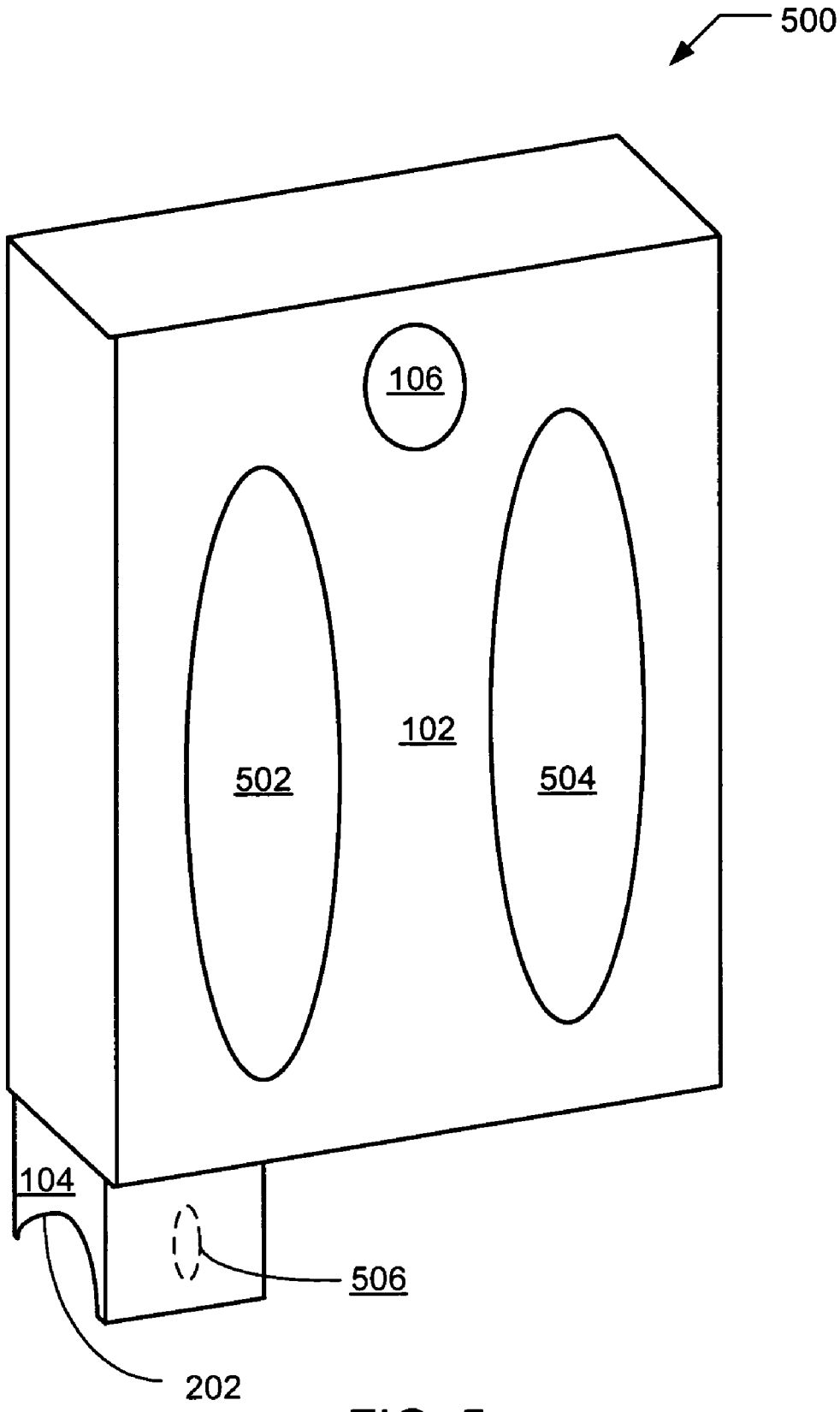
FIG. 5 is a diagram of the three-dimensional view of the magazine loader of FIG. 4 with lightening holes.

In FIG. 5, a diagram 500 of the three-dimensional view of the magazine loader 102 of FIG. 4 with lightening holes 502 and 504 is shown. The lightening holes 502 and 504 may be formed by removing material in the upper portion of the magazine loader 102 by drilling or milling. In other implementations, the upper portion may be formed with lightening holes 502 and 504 when molded or cast. The purpose of the lightening holes is to reduce the overall weight of the magazine loader 102. The lightening holes 502 and 504 may be in addition to a lanyard hole 106. Lightening holes, such as hole 506, may also be formed or machined in the extension 104.

Figure 6:
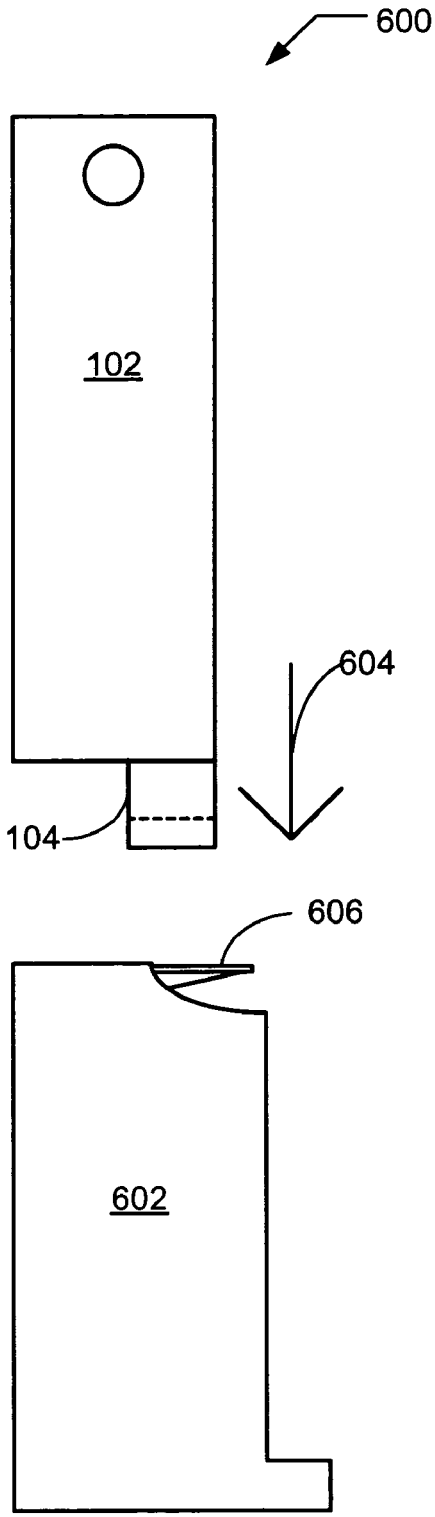
FIG. 6 is a diagram of the magazine loader of FIG. 1 prior to being inserted into a firearm magazine.

Turning to FIG. 6, a diagram 600 of the magazine loader 102 of FIG. 1 prior to being inserted into a firearm magazine 602 is shown. A firearm magazine is positioned parallel to the length of the magazine loader 102 and centered directly underneath the extension 104 (Action Post), with the Action Post placed between and in close proximity to the magazine feed lips. The hand grasping the loader, drives the extension 104 with a downward motion 604 into and between the magazine's feed lips and depresses either the magazine follower 606 or the casing of the top-most loaded bullet or round until the travel of the magazine loader 102 is stopped by the stop ledge plane 108 of the upper portion.

Figure 7:
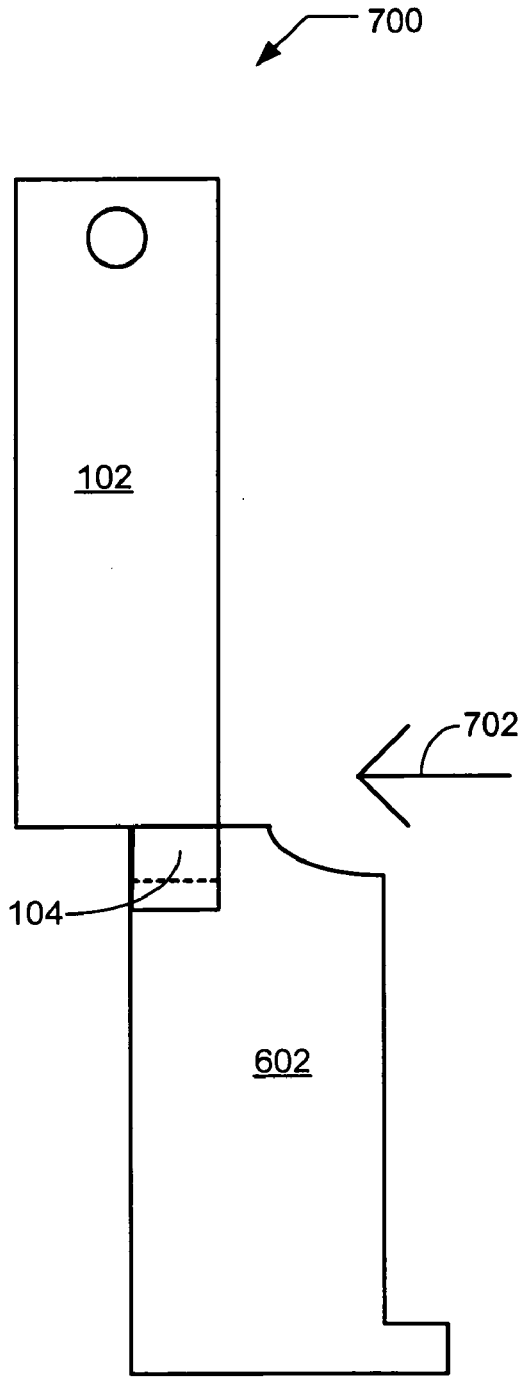
FIG. 7 is a diagram of the magazine loader of FIG. 1 after being inserted into a firearm magazine.

In FIG. 7, a diagram 700 of the magazine loader 102 of FIG. 1 after being inserted into a firearm magazine 602 is shown. With the extension 104 at that depth in the firearm magazine 602, the magazine loader 102 is then pulled back 702 as far as possible up against the inside surface of the back plate or spine of the firearm magazine 602 and held solidly in that position by the grasping hand.

Figure 8:
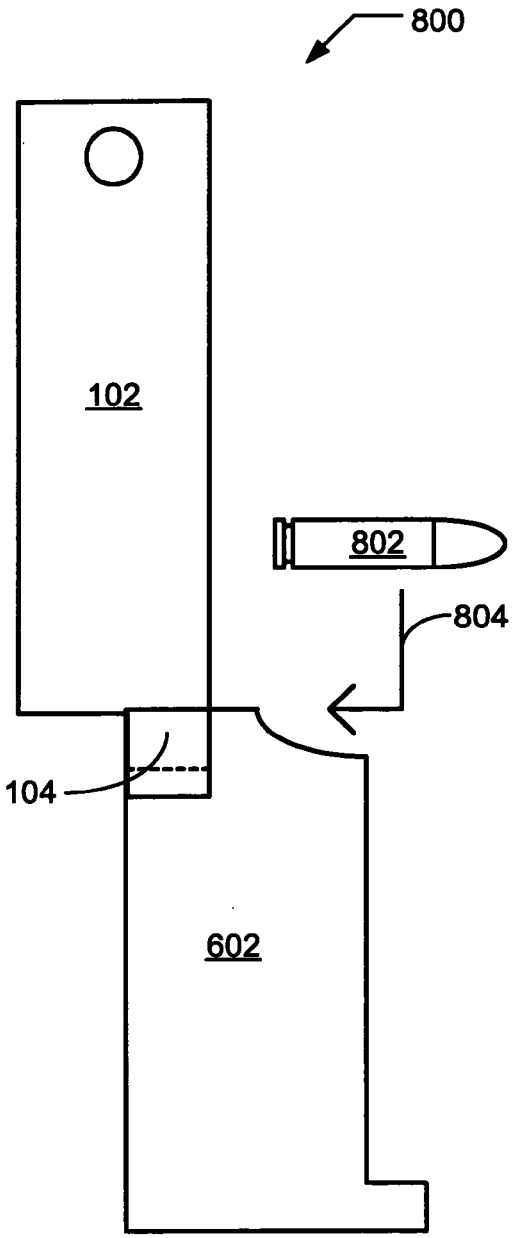
FIG. 8 is a diagram of the magazine loader of FIG. 1 with a cartridge being inserted into a firearm magazine.
Figure 9:
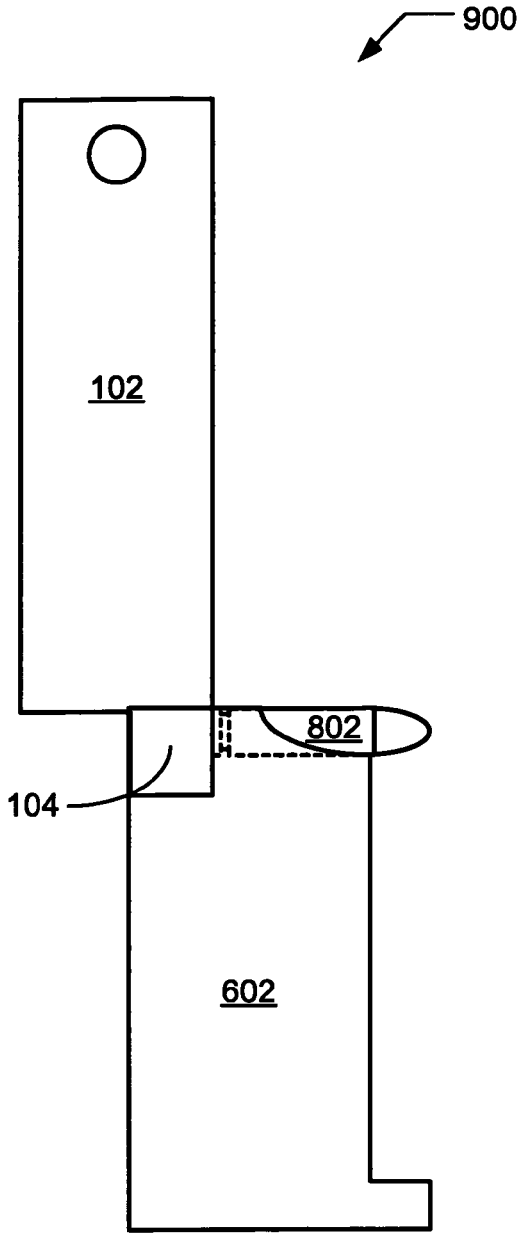
FIG. 9 is a diagram of the magazine loader of FIG. 1 after a cartridge has been inserted into the firearm magazine.

Turning to FIG. 8, a diagram 800 of the magazine loader 102 of FIG. 1 with a cartridge 802 being inserted into a firearm magazine 602 is shown. The free hand (not holding the magazine loader 102) retrieves a loose cartridge 802, bullet or round, orients the primer side of the cartridge 802 between and under the magazine feed lips of magazine 602 and pushes the cartridge inward 804 until it contacts the leading edge of the extension 104 of the magazine loader 102 within the magazine 602 as shown in the diagram 900 of FIG. 9.

Figure 10:
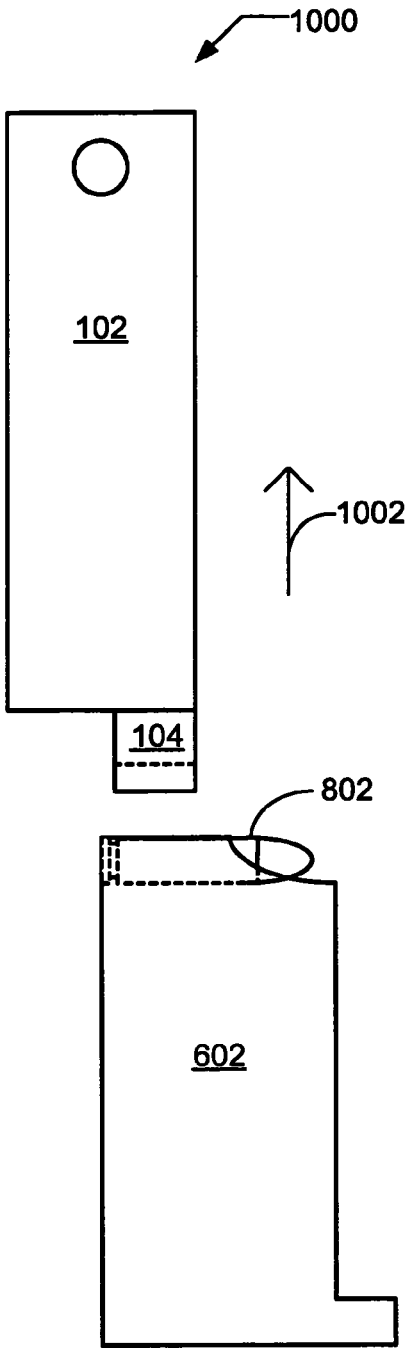
FIG. 10 is a diagram of the magazine loader of FIG. 1 after removal from the firearm magazine and seating of the cartridge in the firearm magazine.

In FIG. 10, a diagram 1000 of the magazine loader 102 of FIG. 1 after removal from the magazine 602 and seating of the cartridge 802 in the firearm magazine 602 is shown. The magazine loader 102 is removed by pulling up with an upward motion 1002 on the magazine loader resulting in the extension 104 being removed from the firearm magazine 602. The hand grasping the loader withdraws the Action Post out of the magazine and the magazine spring pushes the follower and all previously loaded rounds upwardly against the magazine feed lips. The top-most cartridge just loaded is partially held in its temporary place, and is then pushed backwards as far as possible and up against the inside edge of the back plate or spine of the magazine 602 to complete the loading process. The use of the tool as a loader previously described is repeated for each successive round of ammunition wanting to be loaded into the firearm magazine 602.

Figure 11:
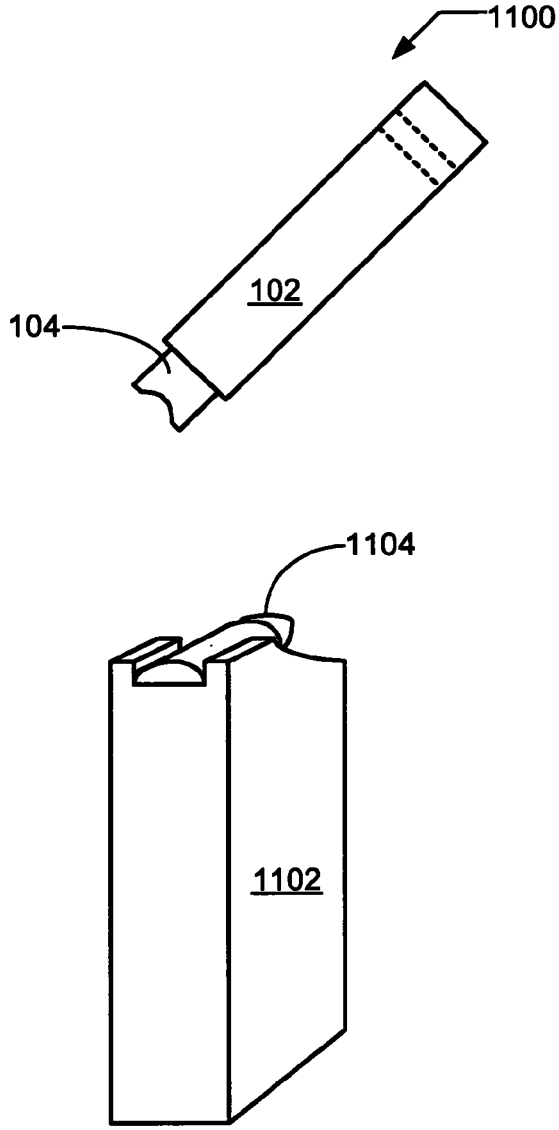
FIG. 11 is a diagram of the magazine loader of FIG. 1 and a loaded firearm magazine.

In FIG. 11, a diagram 1100 of the magazine loader 102 of FIG. 1 and a loaded firearm magazine 1102 having at least one cartridge 1104 is shown. The magazine loader is also capable of assisting in the quick unloading of ammunition rounds or cartridges from firearm magazines. The loaded magazine 1102 is held in one hand and the magazine loader 102 is held in a fist-like grip of the grasping hand, but is oriented in an upside-down fashion where the extension 104 is protruding from the opening created by the index finger and the top end is protruding from the opening created by the pinky or outermost finger. The magazine loader 102 is held in an approximate 45 degree angle and then one of the flat sides of the extension 104 is placed flatly upon the back edge of the top-most ammunition round as shown in FIG. 12.

Figure 12:
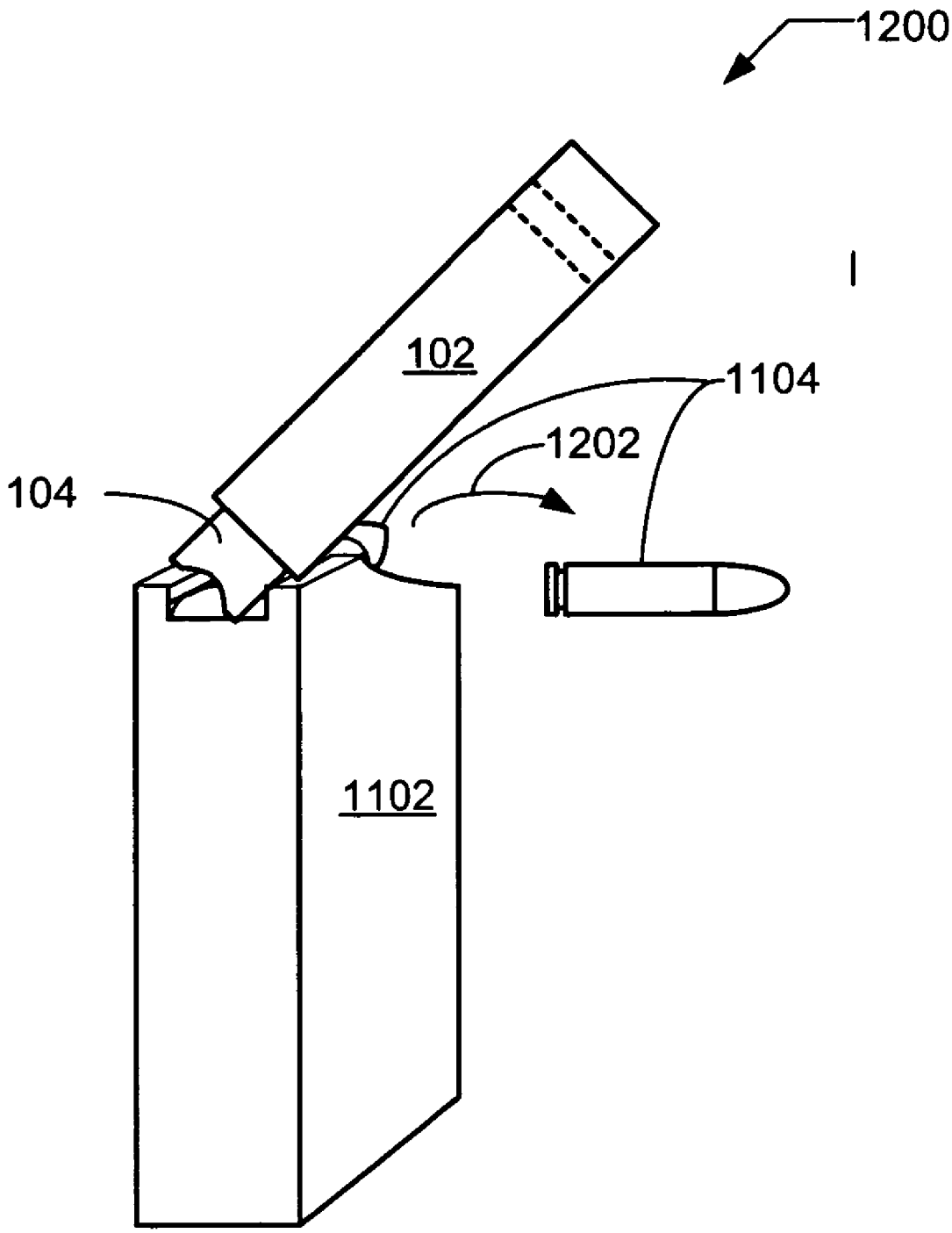
FIG. 12 is a diagram of the magazine loader of FIG. 1 removing a cartridge from the loaded firearm magazine.

Turning to FIG. 12, a diagram 1200 of the magazine loader 102 of FIG. 1 removing a cartridge 1104 from the loaded firearm magazine 1102 is shown. The grasping hand then pushes the magazine loader 102 in a forward motion 1202, thusly driving the top cartridge 1104 forward and out from under the magazine feed lips, freeing the cartridge 1104 from the magazine 1102. The use of the magazine loader 102 as an unloader is repeated for each successive round of ammunition to be unloaded from the firearm magazine or clip.

In both uses of the magazine loader 102, loading and unloading, the user is provided a time savings benefit, while also enjoying reduced injury to the thumbs, fingers, and hands. The magazine loader 102 may be used by as few as one finger of the grasping hand; or incrementally, two, three, four, or five fingers, depending on the user's handicap, injury, or preferred grasping technique. The magazine loader 102 is also designed with the advantage of compactness or flatness, being only ⅜ (0.375) deep/thick at its widest point in its end-profile. It may be purposely designed for storage or carrying in widely available pistol magazine pouches, or folding knife pouches, or other pouches of similar, compact dimension. In a preferred embodiment the magazine loader 102 may be formed from a single rigid piece of aluminum. In other implementations, the magazine loader 102 may be formed from one or more materials including aluminum, steel, iron, stone, or other material(s), such as rubber, plastics (including resins), resistant to finger or hand bending. In yet other implementations, the upper area of the magazine loader 102 may be formed from one material the extension 104 formed from a different material that is attached to the upper area by glue, friction, welds, screws, and pegs, or a combination of glue, friction, welds, screws and pegs. All measurements of the current implementation are described for "rough stock" and may vary depending on materials used, or alterations made during manufacture and finishing, or by the intended magazine or clip the loader is being designed for; the weight of the loader will also vary depending on any or all of the same, and also on lightening/carriage holes, or cuts, or markings, or engravings or labels affixed thereto.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

What is claimed is:

1. A multiple magazine loader for inserting cartridges into a firearm magazine, comprising:

an upper portion; and an extension with a first end coupled to and projecting from a bottom side of the upper portion, where the extension is adapted to fit between the lips of a magazine and the length of the upper portion along a z-axis being longer than the length of the extension along the z-axis;

the upper portion being longer in maximum length in the z-axis than wide in maximum length in a x-axis and a y-axis respectively;

said extension being coupled to only a portion of said bottom side; wherein a second end of the extension includes a concave surface that is adapted to mate with an outwardly curved surface of an ammunition cartridge;

said upper portion shaped and dimensioned such that it may be gripped in the palm of a user's hand while said extension is at least partially inserted into the magazine between the lips and the entire upper portion is positioned above the magazine.

2. The multiple magazine loader of claim 1, where the upper portion forms a stop ledge plane above the extension.

3. The multiple magazine loader of claim 2, where a space formed by the inward curve is in a direction parallel to the stop ledge plane.

4. The multiple magazine loader of claim 1, where the upper portion is a solid upper area.

5. The multiple magazine loader of claim 4, where the solid upper portion defines at least one hole.

6. The multiple magazine loader of claim 1, where the extension is a solid extension.

7. The multiple magazine loader of claim 1, where the solid extension defines at least one hole.

8. The multiple magazine loader of claim 1, where at least the upper portion is made of metal.

9. The multiple magazine loader of claim 8, where the extension is made of plastic.

10. The multiple magazine loader of claim 8, where the extension is made of metal.

11. The multiple magazine loader of claim 1, where at least the upper portion is made of plastic.

12. The multiple magazine loader of claim 11, where the extension is made of plastic.

13. The multiple magazine loader of claim 1, where the upper portion is coated with a material to aid in gripping the multiple magazine loader.

14. The multiple magazine loader of claim 1, where the upper portion is formed with ridges to aid in gripping the multiple magazine loader.

15. The multiple magazine loader of claim 1, where the upper portion has a rectangle shape.

* * * * *